US005330120A

United States Patent [19]

Tussing

[11] Patent Number: 5,330,120

[45] Date of Patent: Jul. 19, 1994

[54] RACK AND HANDBARROW FOR CARRYING SPOOLS OF WIRE

[76] Inventor: Norman P. Tussing, 1365 SE. 10th St., Warrenton, Oreg. 97146

[21] Appl. No.: 9,838

[22] Filed: Jan. 26, 1993

[51] Int. Cl.[5] ..... B65H 49/32

[52] U.S. Cl. ..... 242/588.2; 242/139

[58] Field of Search ..... 242/96, 86.5 R, 85, 242/129, 129.5, 130, 134, 139, 141, 131; 211/59.2; D8/358, 359; 280/47.19, 47.35

[56] References Cited

U.S. PATENT DOCUMENTS

| | | | |
|---|---|---|---|
| D. 286,493 | 11/1986 | Floyd | 242/96 X |
| 3,858,849 | 1/1975 | Peirce | 242/130 |
| 4,065,073 | 12/1977 | Rohner | 242/131 |
| 4,548,368 | 10/1985 | Tomlinson | 242/129.6 |
| 5,188,308 | 2/1993 | Tussing | 242/86.5 R |
| 5,222,683 | 6/1993 | Blackshire | 242/129 |

OTHER PUBLICATIONS

Cobra Wire Leader Corp., catalog flyer, undated 4-s-pool wire handler.

Model #EC 10 Wire Rack Unidentified catalog, p. 51, undated.

WestRack promotional flyer, undated "Wire Feeder".

*Primary Examiner*—John M. Jillions

*Attorney, Agent, or Firm*—Edward B. Watters

[57] ABSTRACT

A wire rack holding up to eight twelve-pound spools of wire and provided with handles on outboard ends of the rack for carrying the loaded rack by hand to and from a work site. The rack is constructed from metal rod stock and is conveniently stored out of the way on a wall or on a bulkhead in a work vehicle.

9 Claims, 2 Drawing Sheets

RACK AND HANDBARROW FOR CARRYING SPOOLS OF WIRE

BACKGROUND OF THE INVENTION

This invention relates to devices for carrying and transporting articles, and more particularly to improved apparatus for storing and carrying by hand, spools of wire and dispensing wire from the spools.

Most wire, for example, wire used by electricians for wiring electrical circuits, electric-fence wire, etc., is supplied on rotatable reels or spools, which facilitate dispensing the wire from the spool journaled on a spindle Racks for transporting and storing spools of wire are known. Such racks generally comprise various arrangements of spindles, and in many instances, wheels for transporting the rack loaded with heavy spools of wire. Smaller, lighter weight racks, intended to be bearable by hand, for use on smaller projects, and holding and carrying from four to eight spools, are generally provided with a single, centrally disposed handle to facilitate carrying by hand, the ends of the rack being left open for receiving spools on spindles extending from a central support. However, a rack loaded with spools of wire, particularly if it is fully loaded, can be cumbersome and difficult to carry with a centrally disposed handle, each spool weighing about 5 to 7 kilograms (11 to 15 pounds). And if the load is unbalanced, which is frequently the case as wire is unreeled and used from time to time from the various spools, a rack with a central handle is unwieldy. Moreover, such racks, carried from a work site to a vehicle such as a panel truck can be difficult to store securely inside the vehicle.

Accordingly, it is an object of the instant invention to provide an improved rack for storing and carrying spools of wire by hand.

Another object of the invention is to provide an improved handbarrow for storing and carrying spools of wire and for dispensing wire therefrom.

SUMMARY OF THE INVENTION

According to the invention, I provide a new and useful barrow, a support having handles, without a wheel, on which heavy spools of wire can be transported by hand.

My handbarrow has a base with a handle at either end, and a stanchion affixed to the base. A spindle affixed at its proximal end to the stanchion and projecting in cantilever fashion from the stanchion in spaced relation with the base receives the spools of wire journaled on it, allowing me to grasp the base by the handles, one in each hand, and carry the loaded handbarrow, in a stable manner supported at either end, to a job site. Upon reaching a job site, the handbarrow is conveniently set down on its base and the wire dispensed from the spools.

BRIEF DESCRIPTION OF THE DRAWING

While the invention is set forth with particularity in the appended claims, other objects, features, advantages and the construction of the invention will become more apparent, and the invention will best be understood by referring to the following detailed description in conjunction with the accompanying drawing in which:

DESCRIPTION OF THE PREFERRED EMBODIMENT

Figure 1:
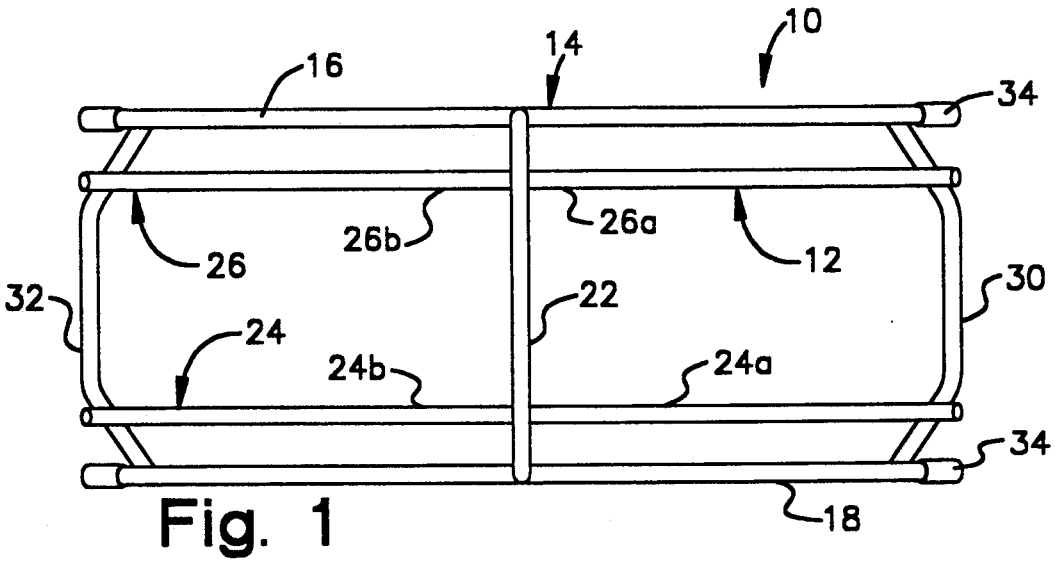
FIG. 1 is a top view of a handbarrow according to the invention.
Figure 2:
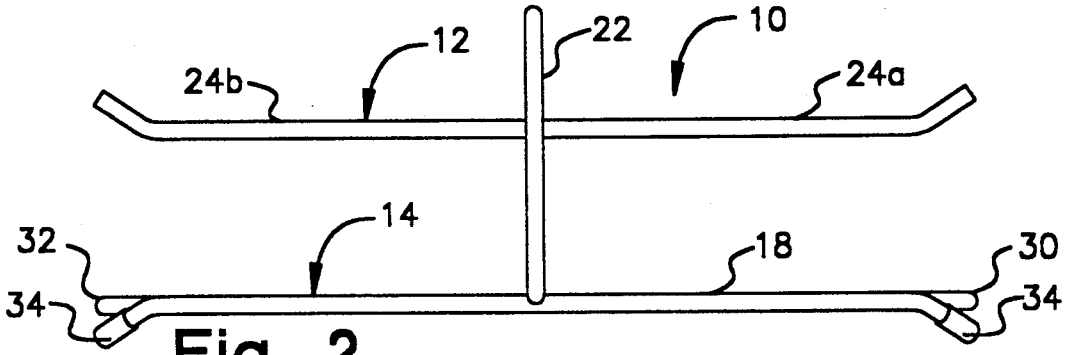
FIG. 2 is a front elevational view of the handbarrow of FIG. 1.
Figure 3:
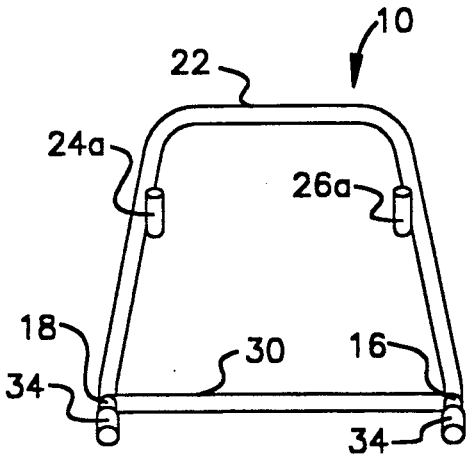
FIG. 3 is a right end view of the handbarrow of FIG. 1.
Figure 4:
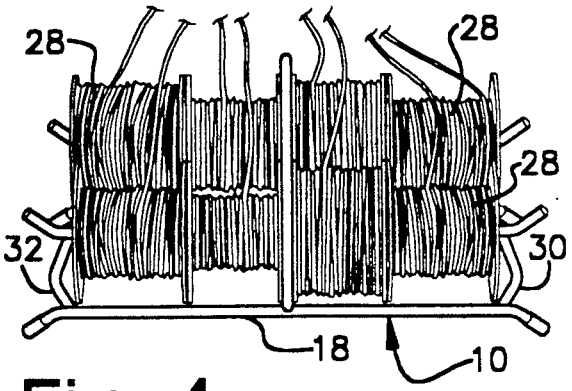
FIG. 4 is a perspective view of the handbarrow of FIG. 1 showing spools of wire journaled thereon.

Referring now to the various views of the drawing for a more detailed description of the components, materials, construction, function, operation and other features of the invention by characters of reference, and in which like characters denote like elements throughout the several views, FIGS. 1–7 illustrate a preferred embodiment of a handbarrow 10 incorporating a rack 12 for storing and carrying spools of wire and for dispensing wire from spools journaled thereon. A "handbarrow" is defined herein as a frame or flat barrow, without a wheel, carried by handles.

The rack 12 is suitably fabricated from metal rod stock, for example, stock of round, square or rectangular cross section. Channel stock and angle iron can also be utilized. The preferred embodiment is made from round stock of 1.3 millimeter (½ inch) diameter. A base 14 of the rack is defined by longitudinal side members 16, 18. A centrally disposed stanchion 22 of inverted U-shape, which is affixed as by welding at its ends to the side members 16, 18, serves as a structural cross member between the longitudinal side members 16, 18.

Longitudinal rods 24, 26 are affixed as by welding interiorly on each side of the stanchion, each of the rods forming two coaxial spindles, designated respectively 24*a*, 24*b*; 26*a*, 26*b*, each spindle being affixed at its proximal end to the stanchion 22 and extending in cantilever fashion over the base. The spindles are generally parallel with the base and spaced apart therefrom by a distance sufficient to allow spools of wire 28 to be journaled thereon, as illustrated in FIGS. 4–7. End portions of each of the spindles are bent upward slightly to prevent the spools from rotating off the spindles as wire is unreeled, or from sliding off when the rack is tilted.

The handbarrow feature of my invention is implemented by cross members 30, 32 affixed at either end of the base 14 between the longitudinal side members 16, 18. The end cross members 30, 32 are suitably angled to form a central portion which defines a handle and facilitates grasping the base of the rack at either end thereof. End portions of each of the longitudinal side members 16, 18 extending longitudinally beyond attachment points of the handles 30, 32 are bent downward to form legs 34 that support the base 14 slightly above a surface on which it rests. Suitable protective coverings such as plastic or rubber boots are provided on ends of the legs 34, which prevent marring the surface on which the handbarrow rests and inhibit sliding of the rack when wire is unreeled from the spools.

Figure 5:
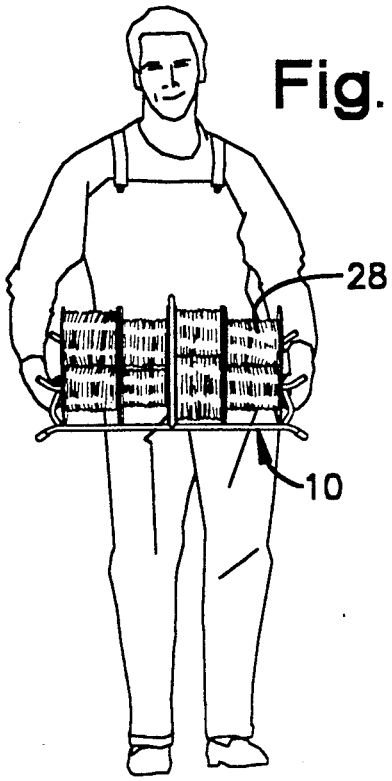
FIG. 5 illustrates the manner in which a handbarrow according to the instant invention, fully loaded, is conveniently carried by a worker using both hands.

In one example of a handbarrow according to the invention, the base incorporates longitudinal side members having a length of 63.85 centimeters (25 ⅛ inches), the side members are spaced 25.4 cm. (10 in.) apart by the cross members. The spindles are conveniently made from rods of the same length as the side members, 63.85 cm. The spindles are spaced 18.4 cm. (7 ¼ in.) apart from each other, and vertically 11.8 cm. (4 ⅝ in.) above the longitudinal side members. The height of the stanchion is approximately 20 cm. (8 in.) above the base. When thus configured, the rack can be loaded, for example, with eight spools of number 12 THHN wire, each spool holding 152.4 meters (500 feet) of wire and weighing 5.7 kilograms (12.5 pounds), the total weight of the fully loaded rack being about 50 kilograms (110 pounds), a load which can be carried with a handbarrow as illustrated in FIG. 5.

Figure 7:
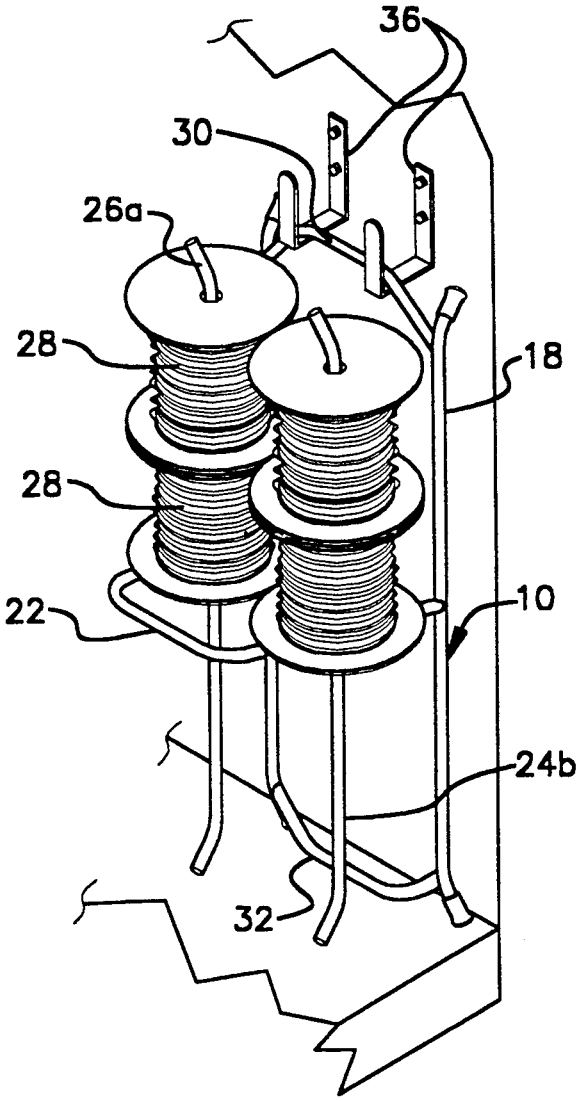
FIG. 7 illustrates the manner in which a handbarrow according to the present invention can be stored vertically, as on a wall or a bulkhead of a work vehicle.
Figure 6:
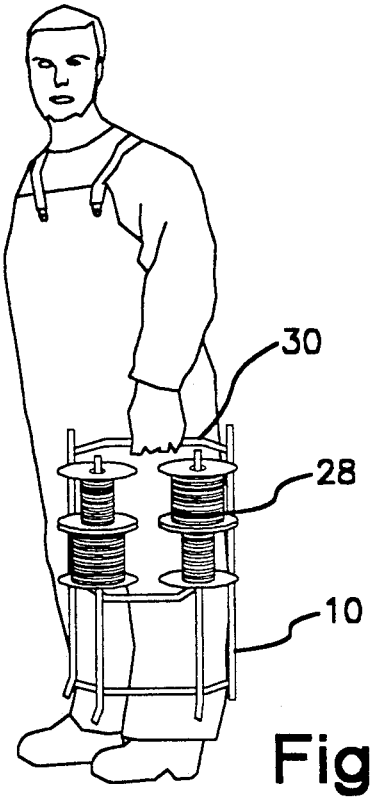
FIG. 6 illustrates a handbarrow according to the instant invention, partially loaded, conveniently carried in a vertical position by a worker using one hand.

When only a few (four or less) spools of wire are needed for a job, the rack can be conveniently carried about in the vertical position with one hand by the handle 30, as illustrated in FIG. 6. FIG. 7 illustrates a handbarrow 10 according to the invention stored in a vertical position against a wall or bulkhead, the handle 30 held in brackets 36.

It will be apparent to those skilled in the art that the disclosed apparatus may be modified in numerous ways, and may assume many embodiments other than the preferred forms specifically set forth and described above. The appended claims are, therefore, intended to cover and embrace any such modifications, within the limits only of the true spirit and scope of the invention.

I claim:

1. A handbarrow, comprising:

a frame adapted to carry spools of wire and dispense wire therefrom, the frame including a generally planar base having a first longitudinal side member, a second longitudinal side member opposite the first side member, a first end, a second end opposite the first end, a first handle at the first end of the base, and a second handle at the second end of the base, the first and second handles defining, respectively, first and second cross members between the longitudinal side members of the base, the frame further including a stanchion affixed to the base and disposed between the longitudinal side members of the base, and a spindle affixed at its proximal end to the stanchion and projecting in cantilever fashion from the stanchion above the base and in spaced relation with the base, the spindle being adapted to receive a spool of wire journaled thereon, the handles being disposed in transverse relation to the spindle, whereby the base of the frame can be grasped by the handles, one in each hand, and carried by a person.

2. The rack according to claim 1, wherein end portions of each longitudinal side member bend downward forming feet supporting the base of the rack above a surface on which the rack rests.

3. The rack according to claim 1 wherein the stanchion comprises an inverted U-shaped element having ends each affixed to one of the longitudinal side members.

4. The rack according to claim 1 further comprising the stanchion centrally disposed between the handles, and a second spindle coaxial with the first spindle, the second spindle being affixed at its proximal end to the stanchion, the second spindle projecting in cantilever fashion from the stanchion above the base and in spaced relation with the base, the second spindle being adapted to receive a spool of wire journaled thereon.

5. In a rack for carrying spools of wire and for dispensing wire therefrom, the rack being formed from metal rod stock and having a generally planar base of generally rectangular shape with longitudinal side members, a stanchion affixed to the base, the stanchion defining a first cross member disposed between the longitudinal side members, and a spindle affixed at its proximal end to the stanchion, the spindle projecting in cantilever fashion from the stanchion in spaced relation with the base for receiving spools of wire journaled thereon, the improvement comprising:

a handle at a first end of the base, and a second handle at a second end of the base opposite the first end, the handles disposed in transverse relation to the spindle and defining cross members of the base at the ends thereof, whereby the rack can be grasped by the handles, one in each hand, and carried by a person.

6. The rack according to claim 5 wherein end portions of each longitudinal side member bend downward forming feet supporting the base of the rack above a surface on which the rack rests.

7. The rack according to claim 5 wherein the stanchion comprises an inverted U-shaped element having ends each affixed to one of the longitudinal side members.

8. The rack according to claim 5 further comprising the stanchion centrally disposed between the handles, and a second spindle coaxial with the first spindle, the second spindle being affixed at its proximal end to the stanchion, the second spindle projecting in cantilever fashion from the stanchion in spaced relation with the base for receiving spools of wire journaled thereon.

9. A handbarrow for carrying spools of wire and for dispensing wire therefrom, comprising:

a rack formed from metal rod stock, the rack having a base with coplanar longitudinal side members, a first cross member between the longitudinal side members, the first cross member defining a handle at a first end of the base, and a second cross member between the longitudinal side members, the second cross member defining a second handle at an end of the base opposite the first end, each of the longitudinal side members having end portions which bend downward to form feet supporting the base of the rack above a surface on which the rack rests;

an inverted U-shaped element defining a stanchion and having ends each affixed to one of the longitudinal side members of the base, the stanchion being centrally disposed between the ends of the base;

a first pair of spindles, each affixed at a proximal end thereof to the centrally disposed stanchion and projecting in opposite directions in cantilever fashion from the stanchion toward the respective ends of the base, the first pair of spindles being spaced apart from the base for receiving spools of wire journaled thereon; and a second pair of spindle, each affixed at a proximal end thereof to the centrally disposed stanchion and projecting in opposite directions in cantilever fashion from the stanchion toward the respective ends of the base, the second pair of spindles being spaced apart laterally from the first pair of spindles and vertically from the base for receiving spools of wire journaled thereon, whereby the rack can be grasped by the handles, one in each hand, and carried by a person.

* * * * *